US006047940A

United States Patent [19]

Kaplan

[11] Patent Number: 6,047,940

[45] Date of Patent: Apr. 11, 2000

[54] REMOVABLY FIXED AND RESTORABLE AUDITORIUM SEATING

[76] Inventor: Charles Kaplan, 102 California Ave., City of Industry, Calif. 91714

[21] Appl. No.: 09/059,597

[22] Filed: Apr. 13, 1998

[51] Int. Cl.[7] ..... A47B 97/00

[52] U.S. Cl. ..... 248/501

[58] Field of Search ..... 248/501, 500, 248/503, 503.1, 223.21, 222.14, 506, 221.12; 297/232; 52/8, 9; 296/63, 65.03; 410/104, 105, 80; 244/118.6

[56] References Cited

U.S. PATENT DOCUMENTS

| | | | |
|---|---|---|---|
| 271,263 | 1/1883 | Phillips . | |
| 874,014 | 12/1907 | Kurtzon | 248/221.12 X |
| 901,561 | 10/1908 | Searing | 248/501 |
| 941,682 | 11/1909 | Knape | 248/243 |
| 1,285,202 | 11/1918 | Jaques et al. . | |
| 1,335,842 | 4/1920 | Lambert . | |
| 1,937,197 | 11/1933 | Halladay | 293/55 |
| 2,153,679 | 4/1939 | Rich | 248/506 |
| 3,986,459 | 10/1976 | Riley | 410/105 X |
| 4,132,335 | 1/1979 | Ingram | 224/42.1 F |
| 4,213,593 | 7/1980 | Weik | 248/501 |
| 4,249,785 | 2/1981 | Hapgood et al. | 312/196 |
| 4,449,875 | 5/1984 | Brunelle | 248/503.1 X |
| 4,473,316 | 9/1984 | Welch . | |
| 4,496,271 | 1/1985 | Spinosa et al. | 410/105 |
| 4,530,483 | 7/1985 | Nordstrom | 248/500 |
| 4,630,982 | 12/1986 | Fenner | 410/102 |
| 4,645,166 | 2/1987 | Checkley et al. | 248/503.1 |
| 4,708,549 | 11/1987 | Jensen | 410/105 |
| 4,723,732 | 2/1988 | Gorges | 410/105 |
| 4,754,943 | 7/1988 | Froutzis | 248/188.1 |
| 4,787,577 | 11/1988 | Whittle | 248/501 X |
| 4,850,769 | 7/1989 | Matthews | 410/105 |
| 4,911,381 | 3/1990 | Cannon et al. | 248/503.1 X |
| 4,932,816 | 6/1990 | Ligensa | 410/105 |
| 4,946,216 | 8/1990 | Demick | 248/503.1 X |
| 5,083,727 | 1/1992 | Pompei et al. | 244/118.6 |
| 5,087,011 | 2/1992 | Turner et al. | 248/501 |
| 5,102,192 | 4/1992 | Barile, Sr. | 297/257 |
| 5,236,165 | 8/1993 | Conway | 248/500 X |
| 5,359,824 | 11/1994 | Koberstein | 52/507 |
| 5,368,354 | 11/1994 | Martin | 396/64 |
| 5,449,132 | 9/1995 | Gilbert | 244/122 |
| 5,501,501 | 3/1996 | White et al. | 296/63 |
| 5,567,016 | 10/1996 | Koprowski | 297/411.32 |
| 5,823,724 | 10/1998 | Lee | 410/104 |
| 5,826,850 | 10/1998 | Goldsmith | 248/501 X |

*Primary Examiner*—Ramon O Ramirez
*Assistant Examiner*—Stephen S. Wentsler
*Attorney, Agent, or Firm*—Marvin H. Kleinberg; Kleinberg & Lerner, LLP

[57] ABSTRACT

This invention provides a mounting structure 10 for releasably securing an auditorium seating unit to the floor. The mounting structure includes a bracket support 12 which is a rectangular casing 32 equipped with openings 40 & 42 interconnected with a pathway slot 46. The mounting structure includes a plate member 16 that is permanently part of the leg or stanchion of the seating unit. The plate member has a stud fastener 52 and a nut/bolt arrangement 62 that depends from the plate member and are received in the openings 40 & 42. The stud 52 and the nut/bolt arrangement 62 are received in the pathway slot 46 and the fasteners 52 & 62 are guided into the openings 40 & 42. The stud 52 and nut/bolt 62 secure the seating unit to the bracket support 12. Cover plates 114 serve to cover the exposed bracket support 12 absent the seating unit 28. The plate member is equipped with a guide element 102 to facilitate locating the openings when restoring the seating unit to this auditorium.

18 Claims, 4 Drawing Sheets

REMOVABLY FIXED AND RESTORABLE AUDITORIUM SEATING

BACKGROUND OF THE INVENTION

1. Technical Field

The invention relates generally to auditorium type seating and more particularly to mounting structures that facilitate the quick and simple removal and replacement of a seating unit in order to vary certain select seating arrangements.

2. Discussion

Permanently installed auditorium seating may, from time to time, require removal of the permanent seats in order to accommodate special uses of the auditorium. Seating arrangements may require being changed to make space available for handicapped persons in wheelchairs that may be attending a performance. In certain circumstances removal may be necessary to extend the stage into the auditorium requiring removal of one or more of the front rows of seats. In all cases it is necessary to quickly remove the seats and then to subsequently restore the auditorium seating to its normal arrangements.

One of the problems with the known mounting structures referred to as "shoes and stretchers" is that they require rather complicated hardware for removably attaching the seating units. When restoring the seating unit to the auditorium floor, portions of the shoes and stretcher structure are in the path of cross aisle walking.

Another problem with the shoe and stretcher arrangement is the proper alignment when restoring the seating unit back in place. A two or three seat unit permanently mounted on the shoe and stretcher presents a rather difficult task of lining up the multiple holes in the stretcher with the anchor mountings in the floor. Another difficulty with the known structures is the availability of fasteners that hold the units in place. Typically, the bolts that secure the structure to the floor become separated when the seating units are removed. Not all of the required bolts always find their way with the seating units. This is due to the fact that there is no provision to make the fastener part of the structural assembly. Understandably, if the seats are replaced with some bolts missing it may create an unstable condition as far as securing the seating unit to the floor.

Other types of structures similar to shoes and stretchers present the same deficiencies in terms of floor obstructions and ease of replacing the seating units.

SUMMARY OF THE INVENTION

The present invention comprises a mounting structure for removably securing a seating unit to a floor or platform which includes a bracket support attached to the floor and a plate member which is affixed to a leg of the seating unit. The plate member is structured to be received in the bracket support. The bracket support comprises a top face which has a set of spaced apart openings and a pathway slot that communicates with openings therein. One of said openings is disposed at the longitudinal end of the top face and a pathway slot that interconnects and is in communication with the set of openings. The underside of the bracket support is equipped with brace means having openings therein. The brace means are aligned with access openings in the top face of the bracket support to receive the fasteners for affixing the bracket support to the floor.

The plate member is affixed to the legs of the seating unit and is structured to be matingly received in the top face of the bracket support. The plate member is equipped with fastener elements projecting from its underside and which are constructed in a manner so that they cannot be separated from the plate member and are adapted to be received in the spaced apart openings. The fasteners projecting from the underside comprise a stud element and a threaded bolt and nut arrangement, the bolt being equipped with a cap element that captures the nut in place thereby preventing its separation from the plate member. Thus, the plate member is structured so that the fastening elements cannot be separated from the plate member. The plate member is secured to the legs of the seating unit in a conventional fashion and becomes part of the leg structure.

The bracket support can be either surface mounted to the floor or secured within a floor recess so that the top face of the bracket is flush with the surface of the floor. A third option permits a surface mounted bracket support to be removed from the floor. With the bracket support in place, the seating unit legs are simply located and precisely aligned with the top of the bracket support so that the projecting stud fastener and bolt head are aligned with the set of openings and are inserted therein. With the fasteners aligned with their respective openings, the seating unit is caused to slide in the direction of the back of the seating unit thereby causing the stud and the bolt head to engage and move along the pathway slot with the stud and the bolt head received below the pathway slot. Upon tightening the nut, the seating unit is firmly secured by friction to the bracket support.

A further embodiment provides the plate member to be equipped with a guide element disposed between the stud fastener and the bolt/nut arrangement and aligned with the pathway slot. The guide element serves to facilitate alignment of the seating unit by guiding fasteners into locking position within the pathway slot.

A further feature of the structure comprises cover plates that fit over the bracket support to protect against exposing the bracket support absent a seating unit so there is no obstruction on the surface of the floor.

One form of cover plate is provided where the bracket support is mounted on the surface of the floor comprising a shallow dished cover plate that matingly engages the bracket and is held in place by guide elements that prevent the bracket support from shifting. In another form of cover plate where the bracket support is disposed in a recess in the floor, a flat cover plate support equipped with a plug element is provided to engage the pathway slot. Both forms of cover plate structures are equipped with elements that engage either the perimeter of the bracket support or the pathway slot so that the cover plate is held in place at the seating unit to provide a smooth floor surface. Optionally, the cover plates may be secured to the floor with conventional bolts that thread into anchors mounted in the floor.

A BRIEF DESCRIPTION OF THE DRAWINGS

It will be appreciated from the following that the present invention presents a significant advance in the field of auditorium seating structures. Additional aspects and advantages of the invention will become apparent from the foregoing more detailed description, taken in conjunction with the following drawings.

DETAILED DESCRIPTION OF THE INVENTION

Figures 1, 2:
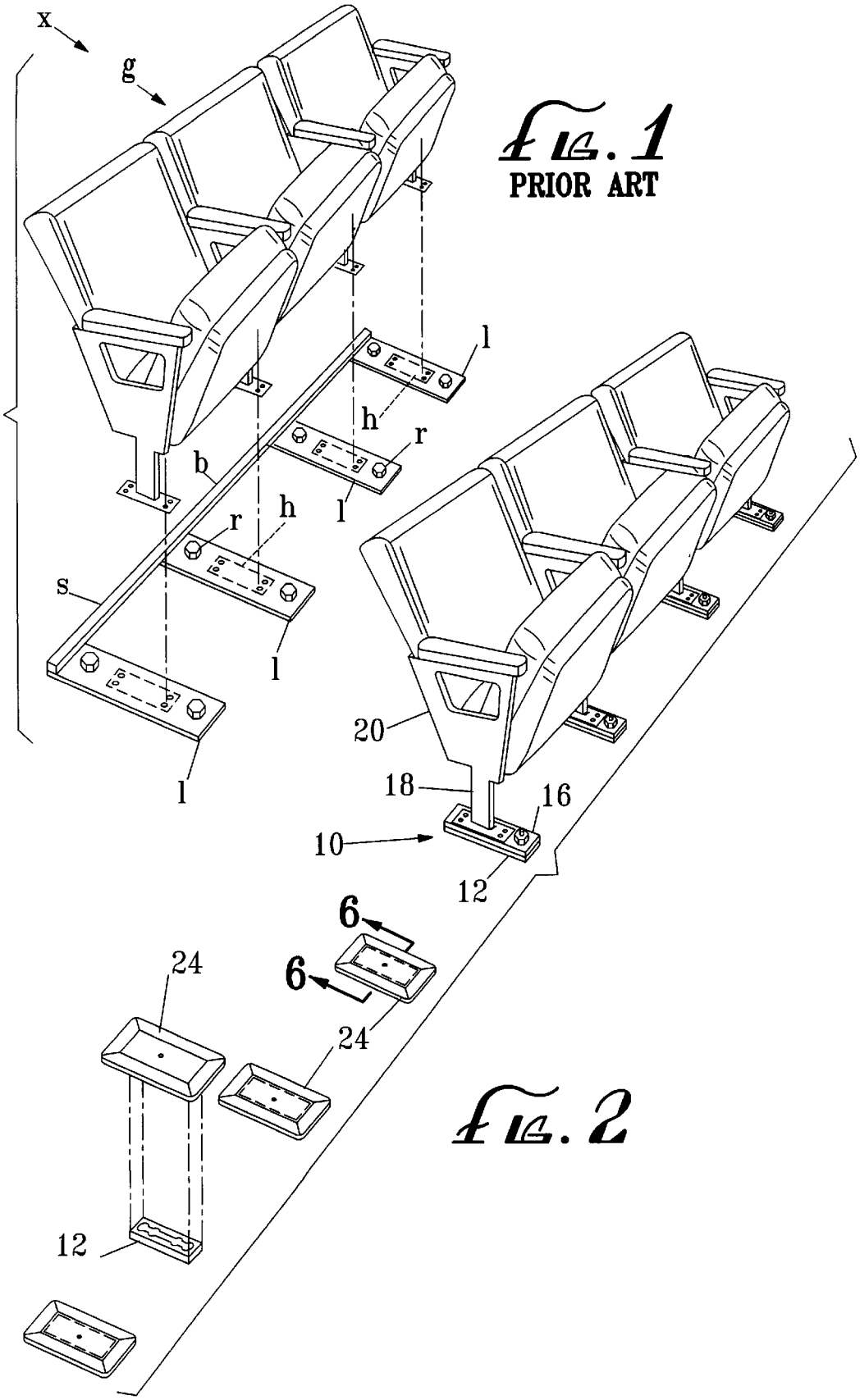
FIG. 1 PRIOR ART
FIG. 1 is a perspective view of the prior known structures for removably affixing a set of seating units to a floor.
FIG. 2 is a perspective view of the mounting structure of the invention showing the bracket supports of this invention fixed to the floor covered with the cover plate and the seating unit with the plate member affixed to the each of the leg portions restored in the prescribed location.

Referring to FIG. 1 there is shown the known prior structure employed in auditorium seating to equip a designated number of the seating units for removal and subsequent replacement. The circumstances that require changing seating arrangement arise when places must be made available to members of the audience in wheelchairs. Other circumstances may require removal of seats when the stage is extended part-way into the auditorium or special types of performances that require greater space that extends into the front rows of permanent seats or permanent seating area in front of the stage. As is presently known, the structures in FIG. 1 identified generally with the letter "x" comprise a series of "U" shaped frames generally identified with the letter "s" comprising a series of leg portions 1 attached to a cross bar "b" known in the art as a "shoe and stretcher".

The shoe and stretchers comprise a pair of leg elements 1 connected by a cross bar b to lend rigidity to the structure. The seating units g are permanently affixed to the legs 1 by welding in the places shown in dotted outline h. The assembly x is removably affixed to the floor with conventional fasteners such as internally threaded anchors (not shown) buried in the floor. When restoring the assembly seating units g and s the entire assembly must be lined up with anchors buried in the floor and then bolted in place with bolts r.

Removal of a seating unit g that is bolted to the floor in this manner is accomplished by removing the bolts r which frees up the assembly x. As will be appreciated when in place, the assembly x presents a complicated structure with cross bar b typically forming an obstruction in the cross-aisle path. Another disadvantage of the assembly x is that when remounting it, not all of the bolts r are available to secure the assembly to the floor which could affect the stability of the restored seating unit.

Referring to FIG. 2 there is shown the structure of this invention identified generally with the reference numeral 10 comprising a bracket support 12 and a plate member 16 affixed to a leg 18 of a seating unit 20. FIG. 2 illustrates the manner in which the leg portion of the seating unit is equipped with the novel assembly of the plate member 16 that combines with the bracket support 12 to removably mount the seating unit 20 to the floor. Overlying the bracket member is a cover plate 24 that serves to shield the exposed portions of the bracket support 12 to avoid posing an obstacle to foot traffic or wheel chairs moving across the floor absent the seating unit 20. It will be appreciated that the cover plate 24 is adapted to fit over the bracket support 12 that is placed in a recess within the floor so that the upper face 36 (FIG. 5) of the bracket support 12 presenting a relatively smooth raised surface on the floor.

Figure 3:
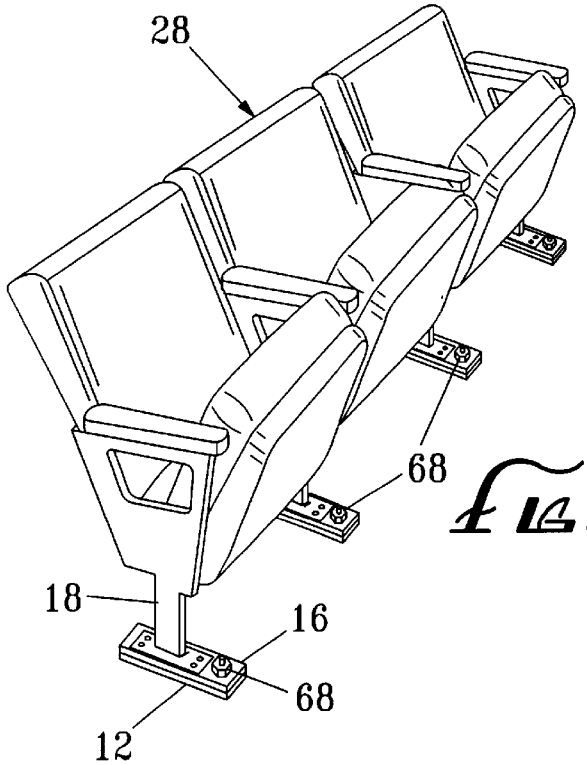
FIG. 3 is a perspective view of a set of seating units in place affixed to the bracket supports that are mounted in recesses in the surface of the floor.

Referring to FIG. 3 there is shown in perspective a 3 seat seating unit 28 which is mounted to the floor. The leg portion 18 is secured to the plate member 16 by being spot welded or riveted to the plate member 16 which is described in greater detail in connection with FIG. 7. The seating unit 28 is removably secured to the bracket support 12 mounted on the floor surface, in a manner as described in greater detail hereinafter leaving the nut 68 (FIG. 5) which is part of the threaded bolt and nut arrangement protruding from the final assembly. It will be appreciated that, unlike the prior known structures, the bracket supports 12 which are mounted on the surface of the floor provide a rather simple and uncomplicated structure that securely holds the seating unit to the floor.

Figure 5:
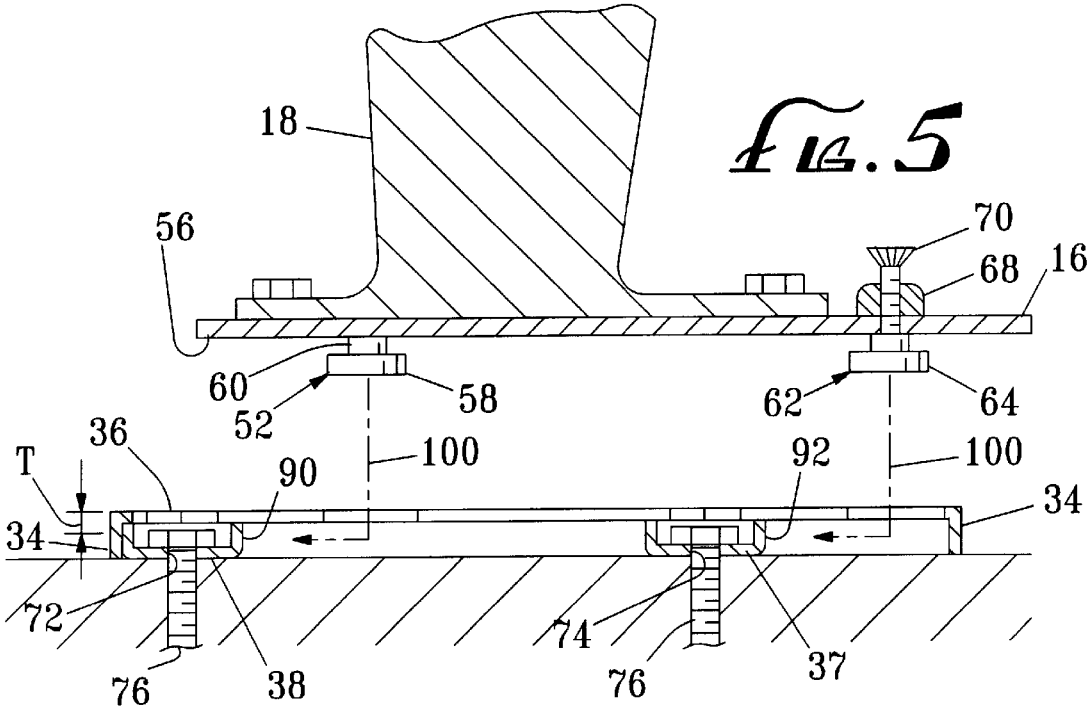
FIG. 5 is a cross-section taken along 5—5 of the assembly of FIG. 4 showing the leg portions of the seating unit inserted into the plate member which in turn is secured to the bracket support.
Figure 4:
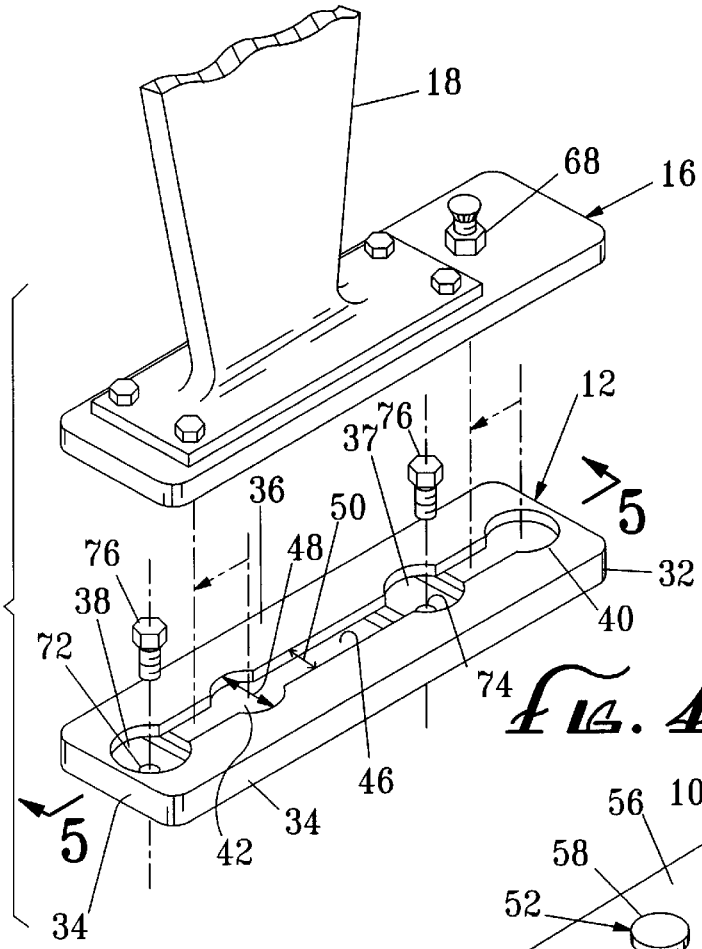
FIG. 4 is an exploded perspective view of the bracket support with the plate member affixed to one of the legs of the seating unit.

The bracket support 12, shown in FIGS. 4 and 5, is essentially a rectangular casing 32 with depending side walls 34 enclosing or surrounding the top face 36 and a bottom brace structure that includes lateral brace structures 37 and 38. The top face 36 has a set of openings 40 and 42 with one of the openings 40 disposed adjacent the longitudinal end of the casing 32. Interconnecting the openings 40 and 42 is a pathway slot 46 that extends substantially the length of the casing 32. The openings 40 and 42 have a first dimension 48 and the pathway slot 46 has a second dimension 50. The dimension 48 is greater than the dimension 50.

Figure 7:
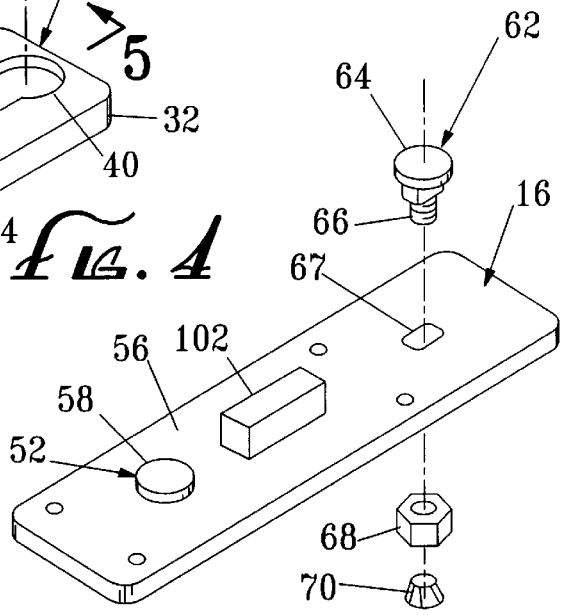
FIG. 7 is a prospective view of another embodiment of the underside of the plate member showing the guide element, the stud and the bolt nut arrangement.

A stud member 52 depends from the under surface 56 wherein the stud member 52 has a flat head portion 58 and a stub shaft 60 (FIG. 5). The length of the shaft 60 closely approximates the thickness "T" of the top face 36 (FIG. 5) of the bracket support 12. A bolt/nut arrangement 62 is captured in the plate member 16 with bolt head 64 on the underside of the plate member and the threaded portion 66 extending through an opening 67 (FIG. 7). The nut 68 is threaded onto the threaded portion 66 and it extends through the plate member 16. The extremity of the threaded portion 66 is topped by a cap 70 that captures the nut 68 preventing the nut from being separated from the arrangement 62. The openings 40 and 42 are adapted to receive the flat head portion 58 of the stud member 52 and the bolt head 64 of the bolt/nut arrangement 62 that are affixed to the plate member as shown in FIG.5.

Referring to FIG. 5, the casing 32 has a top face 36, surrounding depending side walls 34 and bottom brace structures 37 and 38. The brace structure 37–38 perform an important function. Firstly they secure the bracket support 12 to the floor and secondly the brace member 38 forms a necessary registration stop 90 along the pathway slot 46 assuring that the plate member properly lines up the seating units 28 each time they are restored to the auditorium floor. Each brace structure 37 and 38 extends transversely the width of the casing 32. Each brace structure has holes 72 and 74 in order to receive a conventional bolt 76 that anchors the bracket support 12 to the floor.

The top face 36 of the casing 32 has a second set of openings that provide access ways through the top face to the holes 72 and 74 to provide access openings to install the bolts 76. Typically, the floor is provided with internally threaded anchors (not shown) adapted to receive the bolts 76. It will be appreciated that other means may be employed to secure the bracket support 12 in place on or in the floor. The brace structure 38 is located at the end of the pathway slot 46 and its inside edge 90 forms a registration stop for the stud 52. The second brace structure 37 also extends transverse the width of the casing 32 and is positioned rearward of the opening 40 so that its outer edge 92 optionally can form a second registration stop for the bolt-head 64 as the seating unit is advanced in the direction of arrows (shown in dotted lines) 100. Ordinarily, only one registration stop will work well. The distance between the edges 90 and 92 represents the distance between the lead edge of the stud 52 and the lead edge of the bolt-head 64. It will be appreciated that either stop 90 or 92 or both can serve as registration stops for the plate member 16.

It will be appreciated that it is desirable to have the seating units 20 aligned and repositioned to their original place each time they are put back into the auditorium. With the location of the brace structure 37 and 38 and the spacings between the openings 40 and 42 aligned with the stud member 52 and bolt/nut arrangement 62 the seating unit alignment to the fixed bracket support and proper placement is assured.

Figure 6:
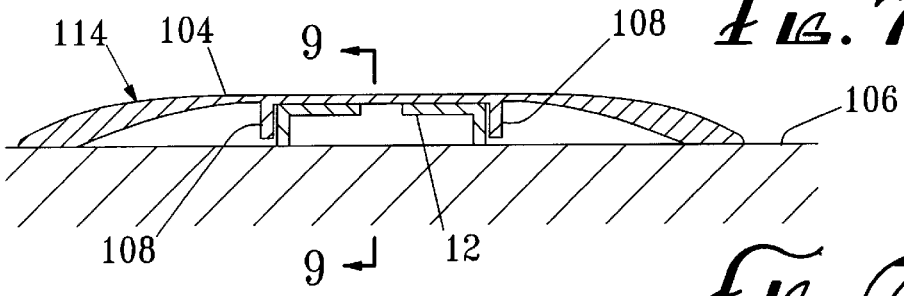
FIG. 6 is a cross-sectional side elevation of the surface mounted bracket support with the seating unit removed and the protective dished cover plate in place.

In another embodiment, the plate member 12 is equipped with a guide element 102 shown in FIGS. 6 and 7. The guide member 102 depends from the underside 56 of the plate member 16 and is aligned with the pathway slot 46. The guide member 102 serves to line up the seating unit with the pathway slot and hence facilitates locating the stud member 52 and bolt/nut arrangement with their respective openings 40 and 42. The alignment again is readily facilitated by sliding the seating unit 20 (FIG. 2) in the direction of the arrow 100.

Figure 8:
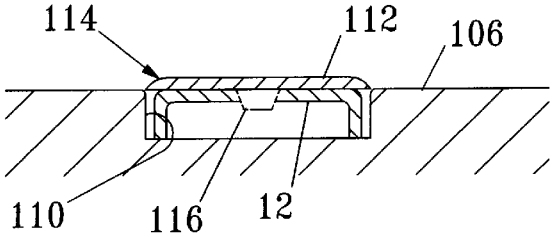
FIG. 8 is a cross-section of a side elevation of the embodiment shown in FIG. 2 with the bracket support mounted in a recess in the floor and the seating unit removed with the flat type protective cover plate.
Figure 5A:
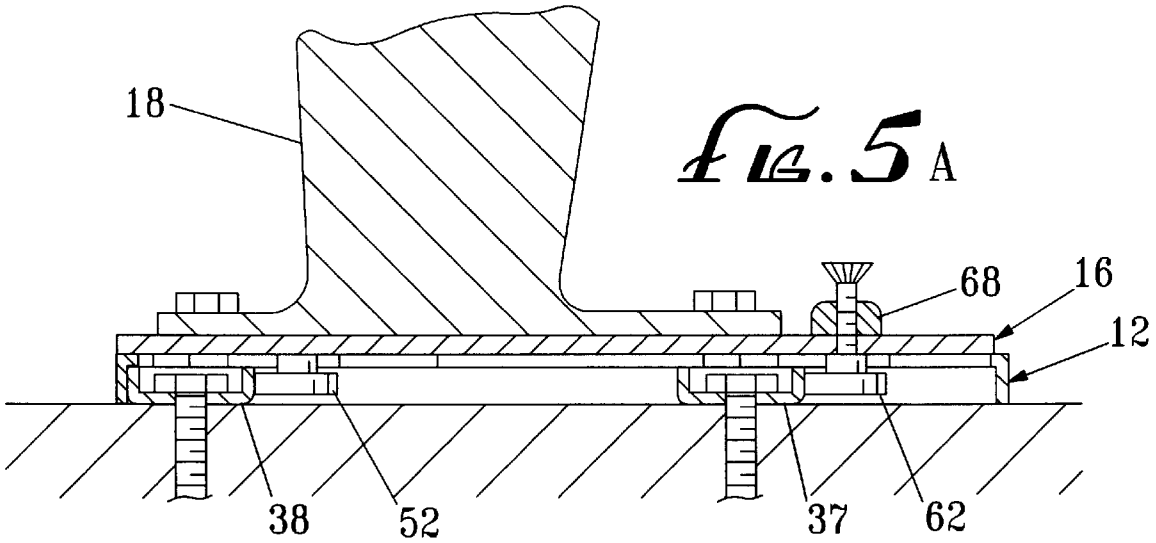
FIG. 5A is a cross sectional view taken of the assembly of FIG. 5 showing the manner of bringing into registration the plate member with the bracket support.

It will be understood that any mounting structure in the floor of an auditorium where people walk to their seats will present some kind of obstruction when the bracket support 12 is exposed absent the seating unit 28. As shown in FIGS. 6 and 8, cover plates 114 are provided as part of the structure to conveniently cover the bracket support 12 which provides a continuous smooth floor area over and surrounding the bracket support. As shown in FIG. 6 a dished cover plate 104 is provided to cover the bracket support 12 when affixed atop the floor surface. With the bracket support 12 mounted atop the floor surface 106 it presents an obstruction to persons walking in the aisles. In order to minimize the hazard, the cover plate 104 has depending from its underside registration wall elements 108 that engage portions of the perimeter of the bracket support 12 locating the cover plate 104 in place preventing it from shifting or uncovering the bracket support 12.

In FIG. 8 there is shown another embodiment of a cover comprising flat cover plate 112 for the case where the bracket support is placed in a recess 110 in the floor. The cover plate 112 is held in place by means of a registration element in the form of a plug 116 that also depends from the underside from the flat cover plate 112. The plug 116 is aligned with the pathway slot 46 of the bracket support 12 thereby holding the cover plate 112 in, forming an even continuous surface over the mounting structure, thereby eliminating obstruction type hazards.

Figure 9:
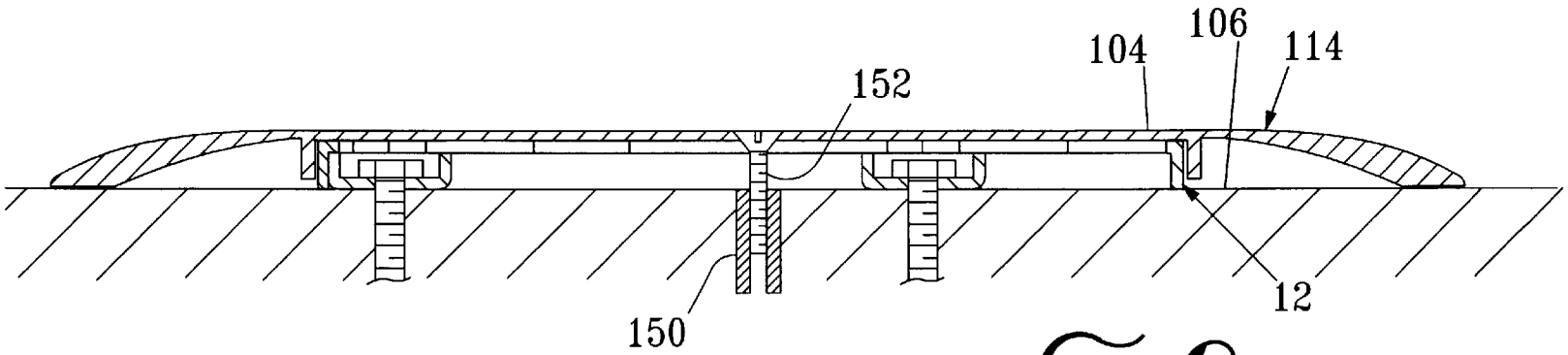
FIG. 9 is a cross-section of the plate member of FIG. 6 showing the manner of optionally securing the cover plate to the floor.

As shown in FIG. 9, it may optionally be desirable to secure the cover plates 114 to the floor to prevent their removal. With the seating unit removed, a suitable anchor type device such as an internally threaded anchor 150 is buried beneath the bracket support and the cover plate 114 maybe equipped with a hole in line with the threaded anchor 150 to receive a bolt 152 which fixes the cover plate 114 in place.

Although the present invention has been described in considerable detail with reference to certain preferred versions thereof, other version are possible. Therefore the spirit of the scope of the appended claims should not be limited to the description of the preferred version contained herein.

What is claimed is:

1. A mounting structure for removably securing a seating unit equipped with a leg support to a floor comprising:

(a) a bracket support having an upper surface and a pair of side walls attached to the upper surface and extending downwardly from the upper surface, the upper surface and side walls forming a casing defining an interior portion of the bracket support, said bracket support upper surface defining sets of first and second spaced apart openings;

(b) said upper surface defining a pathway slot extending between and in communication with each of said openings, one of said second openings being disposed at a longitudinal end of said bracket support, each opening of said sets of openings having a dimension different from a dimension of said pathway slot, said pathway slot dimension being smaller than the dimension of each of said openings;

(c) a plate member for affixing to the leg support of the seating unit, said plate member including a pair of fastening members adapted to be received in said bracket support first openings, one of said fastening members being a stud element fixed to said plate member and the other of said fastening members comprising a bolt/nut arrangement comprising a bolt with a threaded portion and a nut engaging said threaded portion of said bolt, said stud and bolt/nut arrangement aligned respectively with said set of first openings, whereby the seating unit is affixed to said bracket support by inserting said fastening members into said first openings and sliding the seating unit along the pathway slot so that said fastening members engage said slot in a manner in which said stud element is frictionally engaged in said pathway slot and said bolt of said bolt/nut arrangement is secured in said pathway slot by tightening said nut;

(d) a brace structure for attaching said bracket support to the floor, said brace structure located entirely within said interior portion of the bracket support and extending from one side wall of said pair of side walls to the other side wall of said pair of side walls, the brace structure comprising a raised edge forming a registration stop for one of said pair of fastening members.

2. The mounting structure of claim 1, wherein said brace structure defines openings therein for receiving fasteners for attaching said bracket support to the floor.

3. The mounting structure as claimed in claim 2, wherein said openings of said brace structure are aligned with said second openings in said upper surface.

4. The mounting structure as claimed in claim 1, wherein said bracket support is for disposing in a recess in the floor with said upper surface flush with the surface of the floor.

5. The mounting structure as claimed in claim 1, wherein said brace structure is for securing on the surface of the floor.

6. The mounting structure of claim 1 wherein the threaded portion of the bolt of said bolt/nut arrangement is capped, thereby rendering the nut inseparable from the bolt.

7. A mounting structure for removably securing a seating unit equipped with leg supports to a floor comprising:

(a) a substantially rectangular bracket support for securing to the floor, said bracket support comprising a top face having a first and second set of spaced apart openings therein along a longitudinal axis;

(b) said top face defining a pathway slot extending longitudinally between and in communication with said sets of openings, one of said first set of openings being positioned adjacent a longitudinal end of said top face, said sets of openings having a first dimension and said pathway slot having a second dimension, said second dimension being smaller than said first dimension;

(c) a plate member for affixing to the leg supports of the seating unit, said plate member including a pair of fastening members adapted to be received in corresponding ones of said first set of openings in said top face of said bracket support, one of said fastening members being a stud fixed to the underside of said plate member and the second fastening member being a bolt/nut arrangement, said stud and bolt/nut arrangement being spaced apart with the same longitudinal spacing as said set of openings;

(d) underside brace structures arranged transversely from one side of the bracket support to another side of the bracket support, each of said underside brace structures located entirely underneath said top face of said bracket support and underlying a corresponding opening of said second set of spaced apart openings, each of said underside brace structures comprising a raised edge forming a registration stop for a corresponding one of said pair of fastening members; and (e) a cover plate for covering said bracket support to shield said exposed bracket support in the absence of the seating unit being mounted therein.

8. The mounting structure as claimed in claim 7, wherein said cover plate has a dished configuration including securing means for engaging said bracket support to maintain said cover plate in place.

9. The mounting structure as claimed in claim 8, wherein said securing means include a guide element that engages said pathway slot of said bracket support top face.

10. The cover plate as claimed in claim 8, wherein the underside of said cover plate is equipped with a guide element that engages the perimeter of said bracket support.

11. An assembly for removably securing a seating unit equipped with a leg support to a floor having a recess therein, said assembly comprising:

(a) a substantially rectangular bracket support for securing within said recess, said bracket support having an upper surface defining a set of spaced apart openings, said bracket support having a pair of side walls attached to the upper surface and extending downwardly from the upper surface, the upper surface and side walls forming a casing defining an interior portion of the bracket support;

(b) said upper surface further defining a longitudinal pathway slot extending between and in communication with said set of spaced apart openings, one of the openings of said set of spaced apart openings being disposed at a longitudinal end of said bracket support, said set of openings having a first dimension and said pathway slot having a second dimension, said second dimension being smaller than said first dimension;

(c) a plate member for affixing to the leg support of the seating unit, said plate member including a pair of fastening members adapted to be received in said openings of said bracket support, one of said pair of fastening members being a stud element fixed to said plate member and the other of said pair of fastening members comprising a bolt/nut arrangement, said stud and bolt/nut arrangement aligned respectively with the openings of said set of spaced apart openings;

(d) transverse brace structures for attaching said bracket support within the recess in the floor, said brace structures located entirely within said interior portion of the bracket support and extending from one side wall of said pair of side walls to the other side wall of said pair of side walls, the brace structures each comprising a raised edge forming a registration stop for corresponding ones of said pair of fastening members;

(e) covering means for protecting said bracket support when the seating unit is absent, said covering means comprising a dished plate member having registration elements depending therefrom that align with exposed portions of said bracket support;

whereby the covered bracket support is capable of providing an unobstructed surface with respect to the adjacent floor surface.

12. The assembly as claimed in claim 11 wherein said registration elements include a plug that aligns with said pathway slot.

13. The assembly as claimed in claim 11 wherein said registration elements include a depending wall member that engages at least a portion of the periphery of said bracket support.

14. The assembly as claimed in claim 11 wherein said covering means include a dished cover plate contoured to provide a gradual smooth rise over said bracket support relative to the adjacent floor surface.

15. A mounting structure for removably securing a seating unit equipped with leg supports to a floor comprising:

(a) a bracket support adapted to be secured to the floor comprising a substantially rectangular casing having a top surface and longitudinally extending wall portions depending from the top surface, said top surface and said wall portions defining an interior portion of the bracket support, said top surface defining a set of spaced apart openings;

(b) said top surface further defining a longitudinal pathway slot extending between and in communication with said set of openings, one of the openings of said set of spaced apart openings being disposed at a longitudinal end of said bracket support and another opening of said set of spaced apart openings located along said pathway slot toward the other end of said bracket support, said set of openings having a first dimension and said pathway slot having a second dimension, said second dimension being smaller than said first dimension;

(c) attaching means for securing said bracket support to the floor comprising brace structures extending transverse to said longitudinal wall portions from one wall portion of said longitudinal wall portions to another wall portion of said longitudinal wall portions, said brace structures having openings therein that are adapted to receive fastener means therethrough to fasten said brace structures and thereby said bracket support to the floor, said brace structures located entirely within said interior portion of the bracket support, and each of the brace structures comprising a raised edge forming a registration stop.

16. The mounting structure as claimed in claim 15 wherein said openings of said brace structures are aligned with corresponding openings of said set of openings defined in the top surface of the bracket support to facilitate fastener access.

17. In a mounting structure for removably securing a seating unit equipped with a leg support to a floor comprising:

(a) a bracket support adapted to be secured to the floor comprising a casing and having a top surface and longitudinally extending wall portions depending from said top surface, the top surface and the wall portions forming said casing such that said casing defines an interior portion of the bracket support, and a set of spaced apart openings defined in said top surface and a lead edge;

(b) said top surface defining a longitudinal pathway slot extending between and in communication with said set of openings, one of the openings of said set of openings being disposed at one longitudinal end of said bracket support and another opening of said set of openings located along said pathway slot in the direction away from said one end of said bracket support, said set of openings having a first dimension and said pathway slot having a second dimension, said second dimension being smaller than said first dimension;

(c) a plate member for affixing to the leg support of the seating unit, said plate member having a lead edge and said plate member including a pair of fastening members adapted to be received in said bracket support openings;

(d) registration means for locating the seating unit with respect to said bracket support comprising at least one brace structure located entirely within said interior portion of the bracket support, said at least one brace structure extending transverse to said longitudinal wall portions from one wall portion of said longitudinal wall portions to another wall portion of said longitudinal wall portions, said at least one brace structure defining an opening therein adapted to receive fastener means therethrough, said at least one brace structure being located adjacent one of the openings of said set of openings defined in said top surface, each of said at least one brace structure comprising a raised edge forming a registration stop to at least one of said fastener members when said fastener members move longitudinally in said pathway slot so that said lead edge of said plate member coincides with said lead edge of said bracket support.

18. The mounting structure as claimed in claim 17 wherein said pathway slot has access openings therein in alignment with said brace structure openings for receiving said fastener means through said top surface of said bracket support casing for securing said bracket support to the floor.

* * * * *